US005881919A

United States Patent [19]

Womac et al.

[11] Patent Number: 5,881,919

[45] Date of Patent: Mar. 16, 1999

[54] LIQUID INJECTION SYSTEM FOR SPRAYERS

[75] Inventors: Alvin R. Womac, Louisville; Ray A. Maynard, II, Loudon, both of Tenn.

[73] Assignee: The University of Tennessee Research Corporation, Knoxville, Tenn.

[21] Appl. No.: 959,419

[22] Filed: Oct. 28, 1997

[51] Int. Cl.[6] ..... B67D 5/52

[52] U.S. Cl. ..... 222/136; 222/249; 222/333; 222/386.5; 417/413.1; 417/534

[58] Field of Search ..... 222/145.1, 145.5, 222/136, 137, 206, 207, 249, 333, 386.5; 417/413.1, 534; 239/398

[56] References Cited

U.S. PATENT DOCUMENTS

| | | | |
|---|---|---|---|
| 2,675,946 | 4/1954 | Strempel | 222/137 |
| 2,736,466 | 2/1956 | Rodth | 222/136 |
| 3,033,218 | 5/1962 | Callen | 222/249 |
| 3,552,606 | 1/1971 | Kraft | 222/386.5 |
| 4,137,020 | 1/1979 | Ito et al. | 417/534 |
| 4,953,754 | 9/1990 | Credle, Jr. | 222/249 |
| 4,966,306 | 10/1990 | Credle, Jr. et al. | 222/249 |
| 5,121,855 | 6/1992 | Credle, Jr. | 222/129.2 |
| 5,381,926 | 1/1995 | Credle, Jr. et al. | 222/129.2 |

OTHER PUBLICATIONS

Miscellaneous information on Midwest Technologies, Inc. sprayer systems, 4 pages, (date unknown).

Ciba–Geigy, Brochure on Direct Injection System "Agroinject," 8 pages, (date unknown).

Micro–Trak Systems, Inc., Brochure on Trak–Net, Modular Monitoring and Control Network, 5 pages, 1993 (date unknown).

Raven Industries, Brochure on Chemical Injections Systems, 6 pages, (date unknown).

Robert E. Wolf, "Development of a State of the Art Injection Sprayer for Use in Spraying Research Plots," Paper No. 961085, An ASAE Meeting Presentation, Phoenix, Arizona, 7 pages, Jul. 1996.

Capstan AG Systems, Inc., Brochure on Synchro, The New Generation of Ag Spraying Technology, 8 pages, (date unknown).

*Primary Examiner*—Andres Kashnikow
*Assistant Examiner*—Lisa Ann Douglas
*Attorney, Agent, or Firm*—Rosenblatt & Redano, P.C.

[57] ABSTRACT

The present invention is directed to a system for direct injection of chemicals or other additives in a liquid solution into a spray nozzle. The injection system of the present invention may be mounted adjacent, or in close proximity, to the spray nozzles of a sprayer. The present invention comprises a variable speed/stroke diaphragm pump capable of providing a double pumping action such that a liquid solution may be continuously pumped at a controllable rate to one or more spray nozzles of a sprayer.

20 Claims, 4 Drawing Sheets

LIQUID INJECTION SYSTEM FOR SPRAYERS

BACKGROUND OF THE INVENTION

1. Field of the Invention

The present invention is directed to a system for direct injection of chemicals or other additives in a liquid solution into a spray nozzle. The injection system of the present invention may be mounted adjacent, or in close proximity, to the spray nozzles of a sprayer. The present invention comprises a variable speed/stroke diaphragm pump capable of providing a double pumping action such that a liquid solution may be continuously pumped at a controllable rate to one or more spray nozzles of a sprayer.

2. Description of the Prior Art

Traditional agricultural spray systems require the mixing of agrochemical formulation with a water carrier in a sprayer tank. Traditional sprayers pump the mixture of chemical and water to the boom and out through spray nozzles. Errors in chemical measurement, mixing, and calibration, result in increasingly burdensome problems regarding to the disposal of leftover tank mixes, which are frequently considered to be hazardous wastes. Additionally stringent worker protection standards regarding potential exposure to chemicals and accountability standards for disposal of chemicals provide drawbacks which discourage the use of traditional sprayers.

Another approach to agrochemical spraying is direct chemical injection. Direct chemical injection provides benefits of reduced worker exposure, accurate chemical dispensing, reduced waste disposal, and adaptability to variable rate applications. Presently available direct injection systems inject the chemical near the pump or into a spray line that is not located in close proximity to the spray nozzle. A time delay, results between the point of injection and the point of nozzle output. This delay is a problem when trying to match variable chemical rates with particular locations in an agricultural field from a moving sprayer. It is customary for agrochemical boom sprayers to move at velocities from 4–18 mph.

Another problem associated with prior art direct injection systems is their inability to accurately meter the low flow rates associated with agrochemical spraying. Typical application rates for new agrochemical chemistries are as low as 2 ounces per acre. The use of orifices to restrict flow rates for agrochemical mixtures is limited because orifices of diameters less than 0.03 inches inheritantly plug up with formulation debris. Additionally, the regulation of pressures below 10 psi is difficult due to regulator drift. Thus, traditional means of using pressure regulation across orifices to control flow rate have been less than satisfactory with the low flow rate requirements for agrochemical applications.

The present invention provides an apparatus capable of injecting chemicals or other additives in a liquid solution into a spray nozzle at a controllable variable rate for flow rates as low as 1 ml/min. This flow rate corresponds to an application rate of approximately 2 ounces per acre for a boom sprayer moving at 5 mph and comprising a 20 inch nozzle spacing. The design of the present invention permits the injection pump to be placed very close to the outlet spray device or spray nozzle, thereby avoiding time delay problems associated with prior art devices. This invention has many varied applications, including but not limited to, agricultural spraying, food processing and liquid fuel delivery.

SUMMARY OF THE INVENTION

The present invention is directed towards a liquid injection system comprising a housing with a high pressure volume and a low pressure volume. A flexible diaphragm is mounted within the housing so as to separate the high pressure volume from the low pressure volume.

The invention further comprises a rod extending through the housing at a substantially right angle to the diaphragm. The rod is attached to the diaphragm such that when the rod reciprocates it displaces the diaphragm in the direction of rod travel so as to pressurize the high pressure volume and to depressurize the low pressure volume.

The invention further comprises a first inlet line and a first outlet line connected to the high pressure volume and a second inlet line and second outlet line connected to the low pressure volume. A check valve is positioned in each inlet line so as to permit liquid to flow into the high pressure or low pressure volume. A check valve is position in each outlet line so as to permit liquid to flow out of the high pressure and low pressure volumes.

A motor is coupled to the rod so as to cause the rod to reciprocate when the motor is energized. A motor controller is coupled to the motor. The controller is capable of controlling the frequency and/or stroke of reciprocation of the rod. An outlet spray device is connected to the first and second outlet lines from the housing.

DESCRIPTION OF THE PREFERRED EMBODIMENTS

Figure 1A:
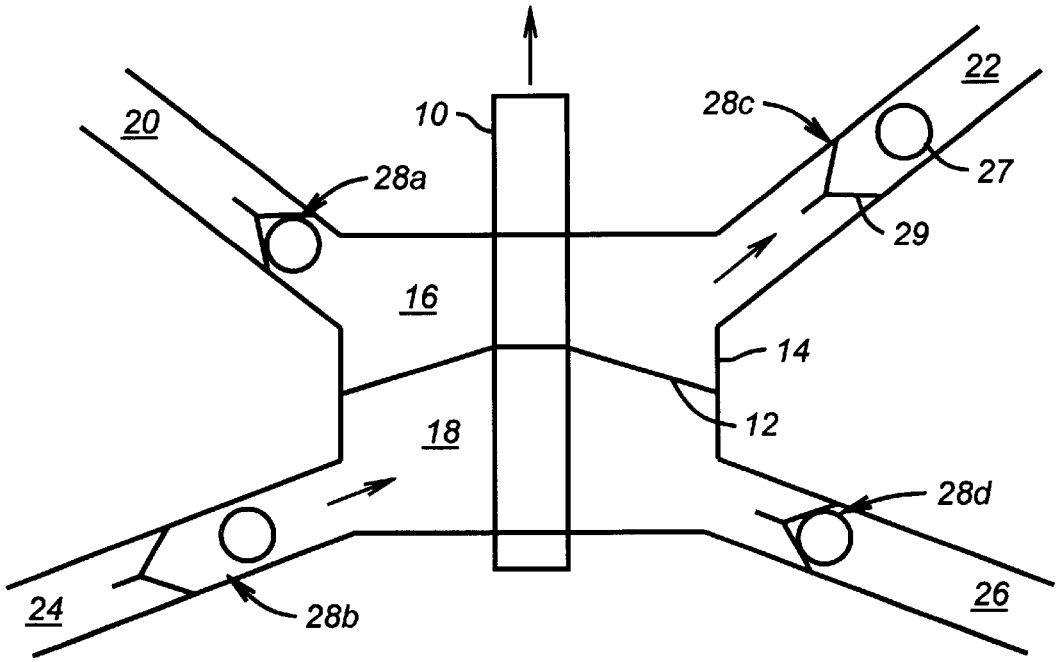
FIG. 1*a* is a cross sectional view of the pump of the present invention when the rod is in the up stroke position.
Figure 1B:
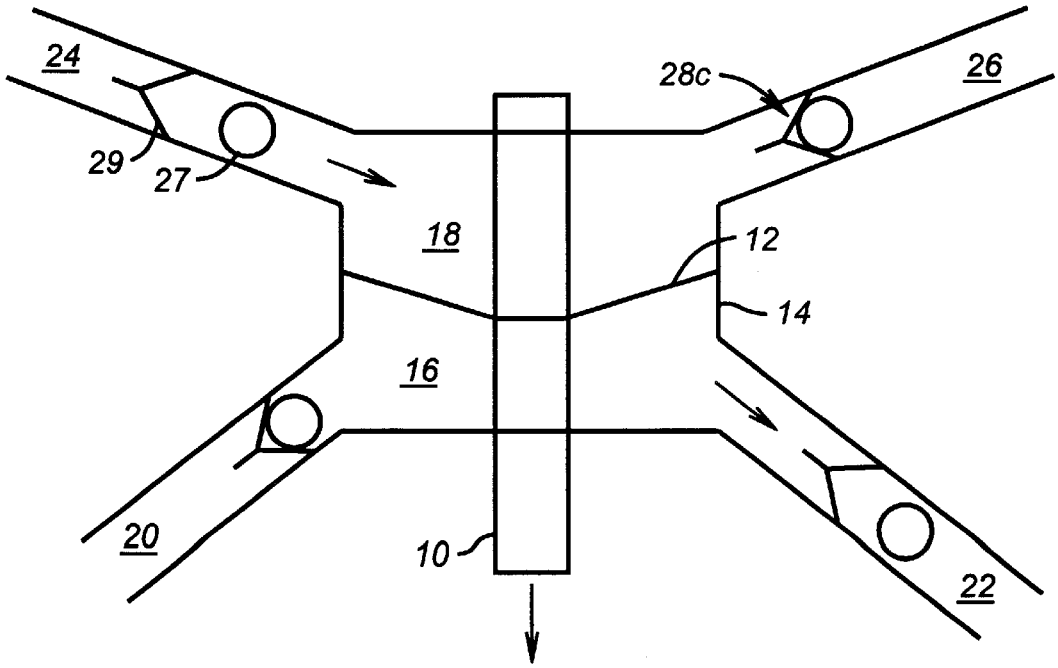
FIG. 1*b* is a cross sectional view of the pump of the present invention when the rod is in the down stroke position.

The present invention comprises a housing 14 comprising a high pressure volume 16 and a low pressure volume 18, as shown in FIGS. 1*a*–1*b*. In a preferred embodiment, the housing is made from plastic.

A flexible diaphragm 12 is mounted within the housing so as to separate the high pressure volume from the low pressure volume as shown in FIGS. 1*a*–1*b*. In one preferred embodiment the diaphragm comprises a synthetic resin comprising fluorine, such as that sold under the trademark Teflon®.

In another preferred embodiment, the diaphragm comprises a center layer made from a flexible metal or from a polymer such as that sold under the trademark Kevlar®. The center layer has a top surface and a bottom surface. This embodiment of the diaphragm further comprises a top outer layer made from a synthetic resin comprising fluorine, such as that sold under the trademark Teflon® and placed against the top surface of the center layer and a bottom outer layer made from a synthetic resin comprising fluorine and placed against the bottom surface of the center layer.

A rod 10 extends through the housing at a substantially right angle to the diaphragm as shown in FIGS. 1*a*-1*b*. In a preferred embodiment, the rod is made from plastic, stainless steel or nylon. The rod is attached to the diaphragm such that when the rod reciprocates it displaces the diaphragm in the direction of rod travel so as to pressurize the high pressure volume and to depressure the low pressure volume. The housing, flexible diaphragm, and rod make up an injection pump used in the liquid injection system of the present invention.

The pump of the present invention is shown in the "up stroke" condition in FIG. 1*a*. As shown in FIG. 1*a*, the diaphragm is displaced in the direction of rod travel. The high pressure volume is the region of the housing above the diaphragm. The low pressure volume is the region of the housing below the diaphragm. The displacement of the diaphragm causes the high pressure volume to be pressurized while at the same time producing a suction or depressurization in the low pressure volume.

In FIG. 1*b* the pump of the present invention is shown in the "downstroke" condition. In this condition, the locations of the high pressure volume and low pressure volume are reversed from that shown in the up stroke condition depicted in FIG. 1*a*.

The invention further comprises a first inlet line 20 connected to the high pressure volume and a first outlet line 22 connected to the high pressure volume. A second inlet line 24 is connected to the low pressure volume and a second outlet line 26 is connected to the low pressure volume.

Check valves 28*a* and 28*b* are positioned in the first and second inlet lines, respectively, so as to permit liquid flow into the high pressure or low pressure volumes, as shown by the arrows in FIGS. 1*a*–1*b*. Check valves 28*c*–28*d* are positioned in the first and second outlet lines, respectively, so as to permit liquid flow out of the high pressure and low pressure volumes, as shown by the arrows in FIGS. 1*a*–1*b*. In a preferred embodiment, the check valves comprise a ball 27 and a seat 29.

Figure 2A:
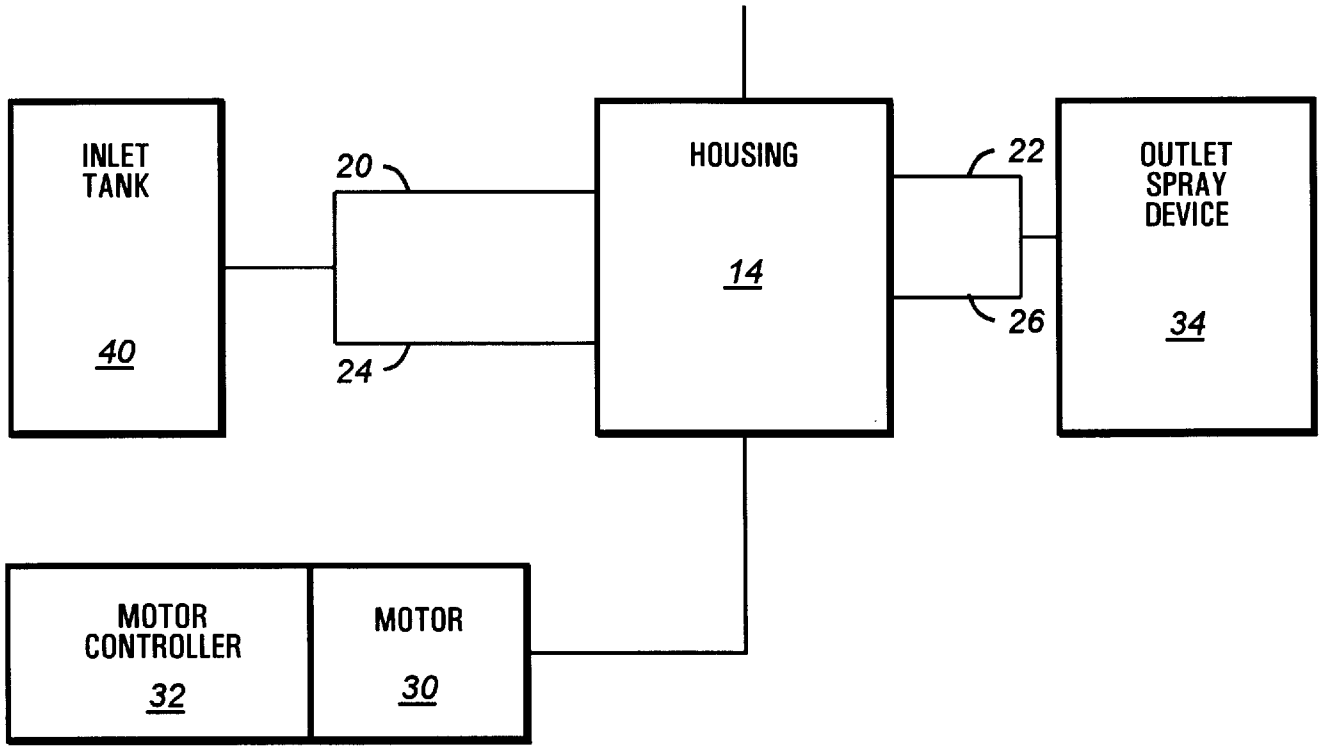
FIG. 2*a* is a block diagram of a first embodiment of the present invention.
Figure 2B:
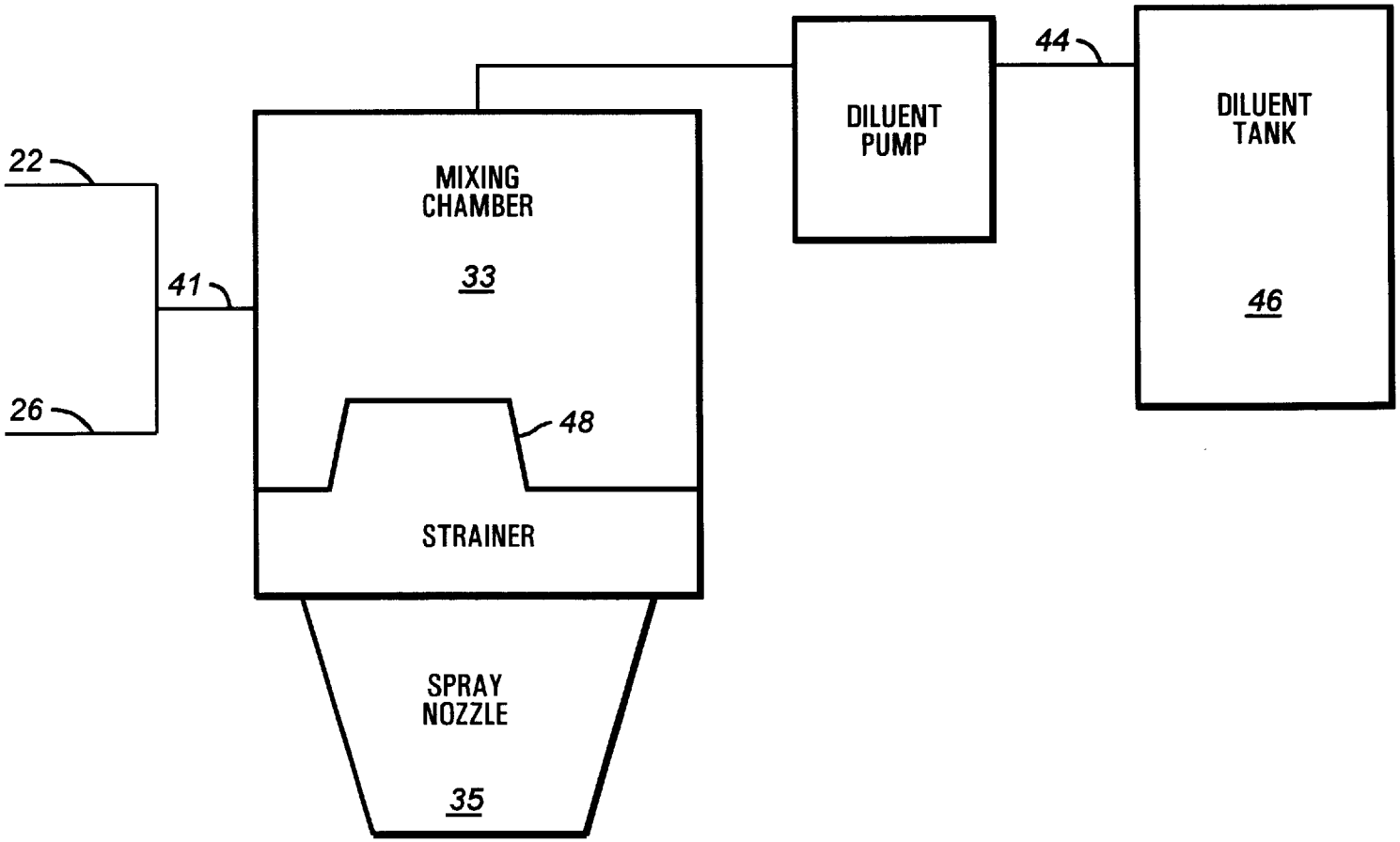
FIG. 2*b* is a block diagram of a second embodiment of the present invention.
Figure 2C:
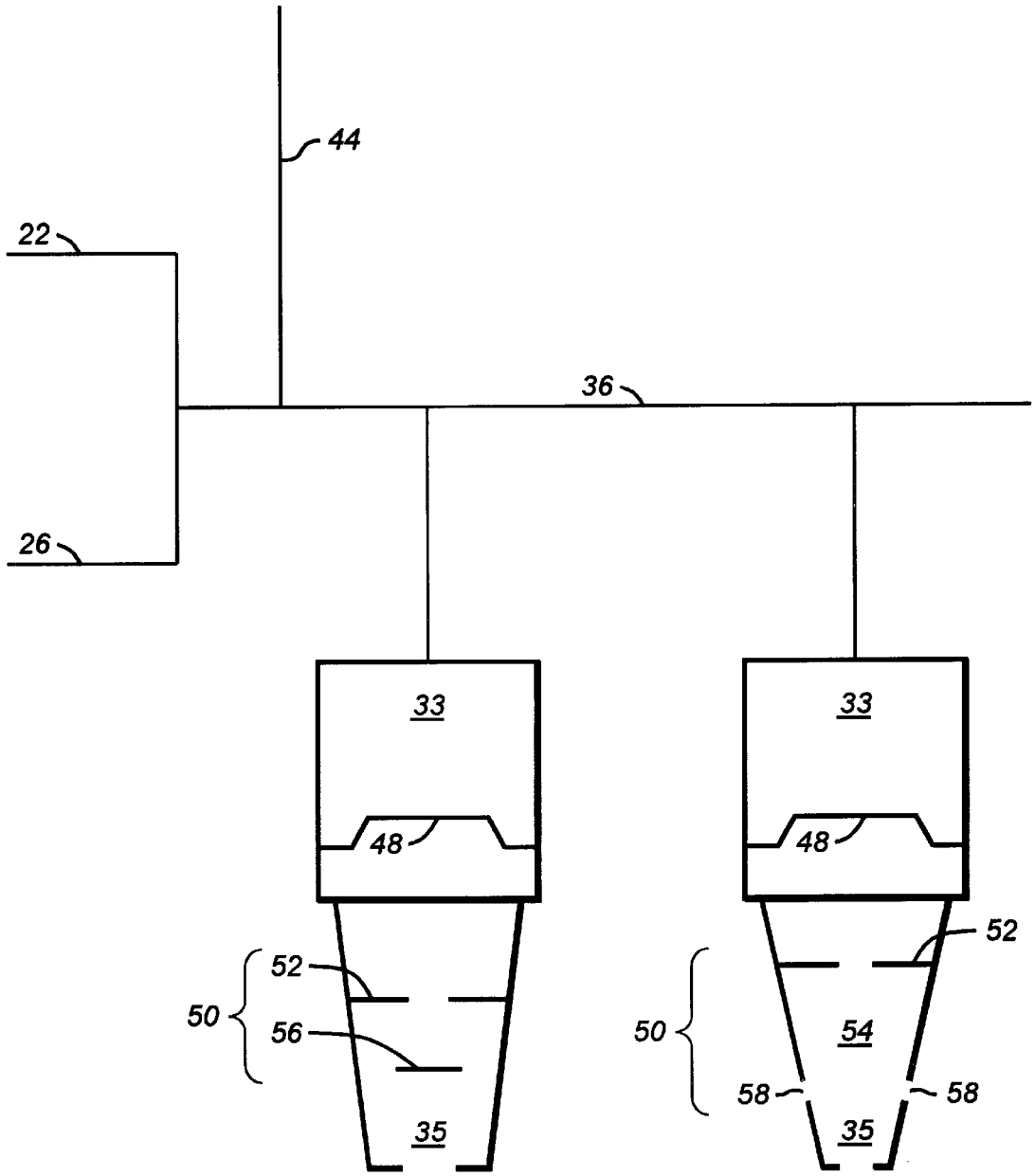
FIG. 2*c* is a side view of a third embodiment of the present invention.

A motor 30 is coupled to the rod so as to cause the rod to reciprocate when the motor is energized, as shown in FIGS. 2*a*–2*c*. In one preferred embodiment, the motor is a stepper motor. In another preferred embodiment, the motor is a variable speed motor. Variable speed motors may be electric, pneumatic or hydraulic. Variable speed motors may comprise rotary or linear drives.

A motor controller 32 is coupled to the motor as shown in FIGS. 2*a*–2*c*. The motor controller is capable of controlling the frequency and/or stroke of rod reciprocation. Variable flow control is achieved with the present invention by controllably varying the rod stroke and/or frequency.

An outlet spray device 34 is connected to the first and second outlet lines, as shown in FIGS. 2*a*–2*c*. The injection pump of the present invention may be placed adjacent, or in close proximity, to the outlet spray device.

In one preferred embodiment, the outlet spray device comprises a mixing chamber 33 connected to the first and second outlet lines, and a spray nozzle 35 connected to the mixing chamber as shown in FIG. 2*b*. In another preferred embodiment, the invention further comprises a boom header 36 connected to one or more mixing chambers as shown in FIG. 2*c*. In another preferred embodiment, an outlet spray header 41 is connected to the first and second outlet lines, as shown in FIG. 2*b*. In a preferred embodiment, a strainer 48 is mounted in each mixing chamber, as shown in FIGS. 2*b* and 2*c*.

The present invention may be used to inject a chemical mixture from a inlet tank to the outlet spray device. In a preferred embodiment of the present invention, an inlet tank 40 is connected to the first and second inlet lines, as shown in FIG. 2*a*. In another preferred embodiment, a diluent header 44 is connected to each mixing chamber and a diluent tank 46 is connected to the diluent header, as shown in FIG. 2*b*.

In another preferred embodiment, a boom header 36 is connected to the first and second outlet lines and at least two mixing chambers are connected to the boom header as shown in FIG. 2*c*. A spray nozzle 35 is connected to each of the mixing chambers. In a preferred embodiment the spray nozzle comprises a device capable of causing turbulent mixing of the fluid being sprayed 50, referred to as a "turbulent mixer". Turbulent mixers may comprise orifices 52 and venturis 54, impact surfaces 56, and/or air inlet ports 58. When the fluid flows through orifice 52 into venturi 54 a suction is created at air inlet ports 58, as shown in FIG. 2*c*. This suction results in the turbulent mixing of air and fluid in the turbulent mixer.

The foregoing disclosure and description of the invention are illustrative and explanatory thereof, and various changes in the size, shape and materials, as well as in the details of the illustrated construction, may be made without departing from the spirit of the invention.

What is claimed is:

1. A liquid injection system comprising:

a. a housing comprising a high pressure volume and a low pressure volume;

b. a flexible diaphragm mounted within said housing so as to separate said high pressure volume from said low pressure volume;

c. a rod extending through said housing at a substantially right angle to said diaphragm, said rod being attached to said diaphragm such that when said rod reciprocates it displaces said diaphragm in the direction of rod travel so as to pressurize said high pressure volume and to depressurize said low pressure volume;

d. a first inlet line connected to said high pressure volume;

e. a first outlet line connected to said high pressure volume;

f. a second inlet line connected to said low pressure volume;

g. a second outlet line connected to said low pressure volume;

h. a check valve positioned in each of said inlet lines so as to permit liquid to flow into said high pressure or low pressure volume;

i. a check valve positioned in each of said outlet lines so as to permit liquid to flow out of said high pressure or low pressure volume;

j. a motor coupled to said rod so as to cause said rod to reciprocate when said motor is energized;

k. a motor controller coupled to said motor, said controller being capable of controlling the frequency or stroke of the reciprocation of said rod; and l. an outlet spray device connecting said first and second outlet lines.

2. The system of claim 1, wherein said rod is made from plastic.

3. The system of claim 1, wherein each of said check valves comprises a ball and a seat.

4. The system of claim 1 wherein said motor is a stepper motor.

5. The system of claim 1 wherein said motor is a variable speed motor.

6. The system of claim 1 wherein said outlet spray device comprises:

a. a mixing chamber connected to said first and second outlet lines; and b. a spray nozzle connected to said mixing chamber.

7. The system of claim 6, further comprising a boom header connected to said mixing chamber.

8. The system of claim 7, further comprising an inlet tank connected to said first and second inlet lines.

9. The system of claim 1, wherein said outlet spray device comprises:

a. a boom header connected to said first and second outlet lines;

b. at least two mixing chambers connected to said boom header; and c. a spray nozzle connected to each of said mixing chambers.

10. The system of claim 1, wherein said diaphragm comprises a synthetic resin comprising fluorine.

11. The system of claim 1 wherein said spray nozzle comprises a turbulent mixer.

12. A liquid injection system comprising:

a. a housing comprising a high pressure volume and a low pressure volume;

b. a flexible diaphragm mounted within said housing so as to separate said high pressure volume from said low pressure volume;

c. a rod extending through said housing at a substantially right angle to said diaphragm, said rod being attached to said diaphragm such that when said rod reciprocates it displaces said diaphragm in the direction of rod travel so as to pressurize said high pressure volume and to depressurize said low pressure volume;

d. a first inlet line connected to said high pressure volume;

e. a first outlet line connected to said high pressure volume;

f. a second inlet line connected to said low pressure volume;

g. a second outlet line connected to said low pressure volume;

h. a check valve positioned in each of said inlet lines so as to permit liquid to flow into said high pressure or low pressure volume;

i. a check valve positioned in each of said outlet lines so as to permit liquid to flow out of said high pressure or low pressure volume;

j. a motor coupled to said rod so as to cause said rod to reciprocate when said motor is energized;

k. a motor controller coupled to said motor, said controller being capable of controlling the frequency or stroke of the reciprocation of said rod;

l. an outlet spray header connected to said first and second outlet lines;

m. at least two mixing chambers connected to said outlet spray header; and n. a spray nozzle connected to each of said mixing chambers.

13. The system of claim 12 further comprising an inlet tank connected to said first and second inlet lines.

14. The system of claim 13 further comprising a diluent header connected to each of said mixing chambers.

15. The system of claim 14 further comprising a diluent tank connected to said diluent header.

16. The system of claim 15 further comprising a strainer in each of said mixing chambers.

17. A liquid injection system comprising:

a. a housing comprising a high pressure volume and a low pressure volume;

b. a flexible diaphragm mounted within said housing so as to separate said high pressure volume from said low pressure volume;

c. a rod extending through said housing at a substantially right angle to said diaphragm, said rod being attached to said diaphragm such that when said rod reciprocates it displaces said diaphragm in the direction of rod travel so as to pressurize said high pressure volume and to depressurize said low pressure volume;

d. a first inlet line connected to said high pressure volume;

e. a first outlet line connected to said high pressure volume;

f. a second inlet line connected to said low pressure volume;

g. a second outlet line connected to said low pressure volume;

h. a check valve positioned in each of said inlet lines so as to permit liquid to flow into said high pressure or low pressure volume;

i. a check valve positioned in each of said outlet lines so as to permit liquid to flow out of said high pressure or low pressure volume;

j. a motor coupled to said rod so as to cause said rod to reciprocate when said motor is energized;

k. a motor controller coupled to said motor, said controller being capable of controlling the frequency or stroke of the reciprocation of said rod;

l. a mixing chamber connected to said first and second outlet lines; and m. a spray nozzle connected to said mixing chamber.

18. The system of claim 17 further comprising a boom header connected to said mixing chamber.

19. The system of claim 17 wherein said motor is a variable speed motor.

20. The system of claim 17, wherein said spray nozzle comprises a turbulent mixer.

* * * * *